United States Patent [19]

Habib et al.

[11] 4,114,926

[45] Sep. 19, 1978

[54] BARRIER COAT FOR USE IN THERMOGRAPHIC IMAGING ASSEMBLY

[75] Inventors: David P. Habib, East Greenwich; Morgan E. Gager, Warwick, both of R.I.

[73] Assignee: Trans World Technology Laboratories, Inc., Fiskeville, R.I.

[21] Appl. No.: 678,455

[22] Filed: Apr. 19, 1976

[51] Int. Cl.[2] ..... B41M 5/00

[52] U.S. Cl. ..... 282/27.5; 427/150; 427/151; 428/341; 428/913; 428/914

[58] Field of Search ..... 427/146, 148, 150, 151, 427/152, 153; 282/27.5; 428/411, 537, 913, 914, 340–342

[56] References Cited

U.S. PATENT DOCUMENTS

| | | | |
|---|---|---|---|
| 2,929,736 | 3/1960 | Miller et al. | 282/27.5 |
| 3,632,376 | 1/1972 | Newman | 282/27.5 |

*Primary Examiner*—George F. Lesmes
*Assistant Examiner*—Bruce H. Hess
*Attorney, Agent, or Firm*—Birch, Stewart, Kolasch & Birch

[57] ABSTRACT

Premature color formation and fogging in composites used in two sheet thermographic imaging systems are prevented by providing a polymeric barrier coating between the two interactive layers. The barrier coat serves to keep the volatilizable organic acid in the donor sheet from diffusing into the dye precursor receptor sheet during storage or transport, but permits the desired diffusion at thermographic imaging temperatures. Suitable barrier coat layers, which must be acid-resistant, include chlorinated rubber, chlorinated polypropylene, styrene-acrylonitrile copolymer, chlorinated paraffins, polystyrene and vinyl chloride-vinyl acetate copolymer.

16 Claims, 1 Drawing Figure

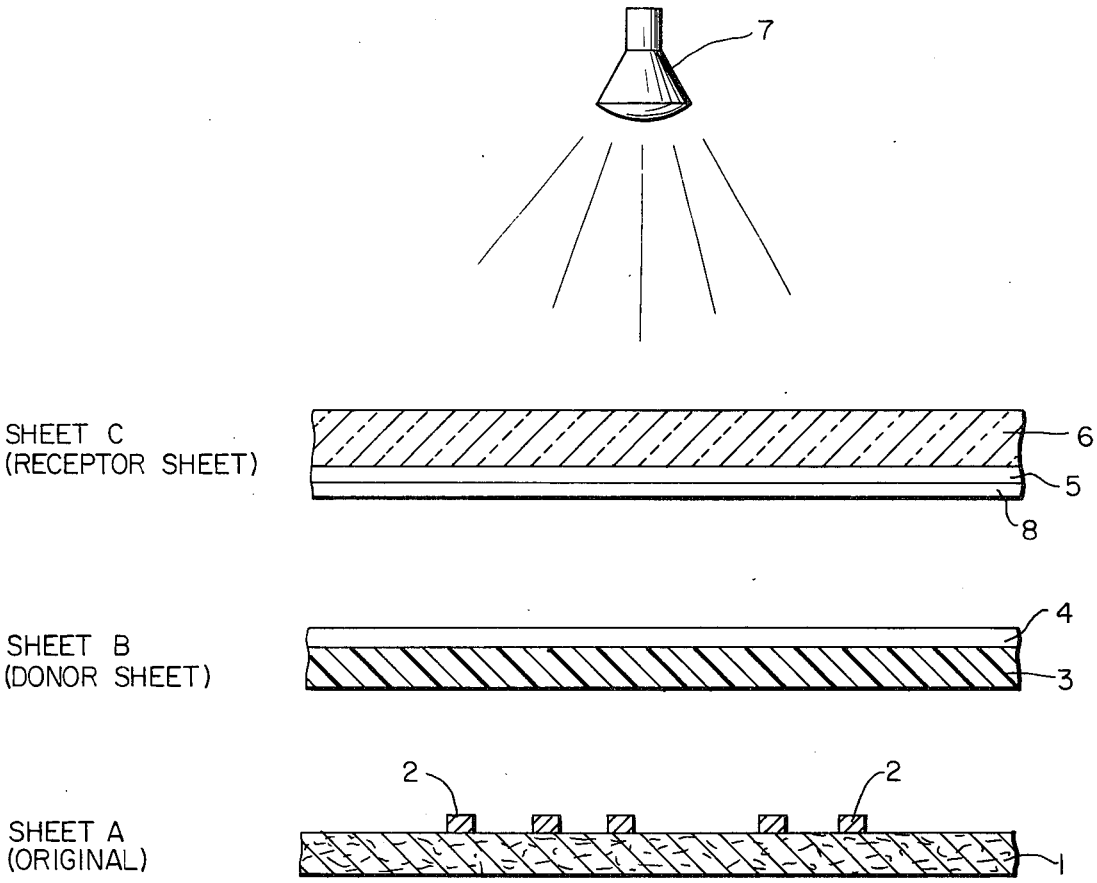
7
SHEET C
(RECEPTOR SHEET)
6
5
8
SHEET B
(DONOR SHEET)
4
3
2
2
SHEET A
(ORIGINAL)
1

BARRIER COAT FOR USE IN THERMOGRAPHIC IMAGING ASSEMBLY

This invention relates to a barrier coat for use in a thermographic imaging assembly. More particularly, the invention relates to a barrier coat to be employed between an assembly comprising a donor sheet containing a heat volatilizable organic acid and a receptor sheet containing a protonatable chromogeneous dye-forming color progenitor.

Overhead projectors, for example as described in U.S. Pat. No. 3,126,786, are widely used in classrooms as teaching aids or in meetings for demonstrations and the like. Projection from transparency reproductions of printed or pictorial originals is convenient and greatly enhances communications and an understanding of the material being projected. Black-and-white transparencies have been easily and quickly prepared by thermographic copying techniques, for example, by the method as described in U.S. Pat. No. 3,111,584.

Heat sensitive copy sheets are known which change color, when thermographically heated, through a dye-forming reaction between a dye-forming chromogenous electron donor material and an organic acid, such as salicylic acid or benzoic acid. The process of thermographic imaging utilizing a two-sheet system based upon this mechanism to form color transparencies or images on film supports is exemplified by U.S. Pat. No. 3,483,013 of Berg et al., U.S. Pat. No. 3,695,912 of DeLaurentis et al and British Pat. No. 1,204,567. In the two-sheet thermographic imaging process as shown in the accompanying drawing, an original sheet (A) carrying infrared radiation-absorbing images is superposed with a volatilizable acid-containing donor sheet (B) and a dye-precursor receptor sheet (C) in which both the donor and receptor sheets are infrared transmitting. Infrared radiation is applied to induce selective heating of the original images which causes the acid in the heated portions of the donor sheet to volatilize and penetrate the receptor sheet and to react with the dye precursor, thereby forming a copy of the original sheet.

One of the problems with such donor-receptor sheet assemblies is that during normal storage of the composite, that is, prior to its use in imaging, the acid in the donor sheet diffuses into the receptor sheet causing premature color formation or fogging. This problem may occur during transport of the material or during storage prior to its use in the thermal imaging machine.

Accordingly, one of the objects of the present invention is to provide a donor-receptor composite assembly having a barrier coating which serves to prevent premature color formation or fogging.

Another object of the invention is to provide a thermographic imaging assembly which can be used effectively and conveniently to give a sharp, dense and permanent image which corresponds to the original.

These and other objects and advantages of the present invention will become apparent to those skilled in the art from a study and consideration of the following specification and claims, taken in conjunction with the accompanying drawing which schematically shows a two-sheet system as employed in the thermographic imaging process.

In accordance with the present invention is has been found that premature color formation and fogging may be prevented by providing a barrier coating of very specific character to separate the two interactive layers.

The necessary parameters for such a barrier coating are as follows:

1. Low acid permeability at storage and shipping temperatures (i.e., 0°-140° F.).
2. Thermoplasticity and therefore high acid permeability at thermal imaging temperatures.
3. The barrier layer must be acid resistant so that it will not react with the acid to impair or circumvent the barrier function.
4. The barrier layer must be relatively thin so as not to entrap the acid during its course of travel into the dye precursor layer.

This substantially chemical means of providing a barrier coating is greatly advantageous as compared to the interleaving separation sheets previously used in the prior art in order to separate the donor and receptor sheets prior to use. Thus, the present invention makes it possible to use the donor-receptor sheet assembly without the need or bother of removing the separating sheets. Hence, the assembly of the invention can be used more quickly and efficiently.

The accompanying drawing illustrates an acid donor sheet B wherein element 3 is a base substrate material, such as a polyester film, having an acid layer 4 thereon, said acid layer containing a volatilizable acid and, optionally, a fatty acid or fatty acid salt, and a polymeric binder. The acid layer suitably has a thickness of from about 0.03 to 0.3 mil, depending on the particular formulation employed. However, the significant factor is that there be sufficient acid present in the donor sheet to react with the dye precursor in the receptor sheet to form the desired images.

The receptor sheet C contains a dye layer 5 disposed on a substrate base material 6, such as a polyester or polystyrene film . In accordance with the invention, receptor sheet C may contain barrier coating 8 on dye layer 5. Alternately, the barrier coat may be applied over the acid layer 4 of the donor sheet B (not shown) or on both the dye layer 5 and acid layer 4 (not shown).

In practice, the donor sheet B and receptor sheet C, or composite, are placed in face-to-face contact, i.e., acid layer 4 is contacted with barrier layer 8 and an image is reflexively formed by passing the composite through a thermal imaging machine having an infrared radiation lamp 7, with the donor sheet substrate 3 in contact with the original image areas 2 which are supported on substrate 1 of sheet A.

Heat volatilizable acids such as salicylic acid, benzoic acid and 5-chlorosalicylic acid may typically be used in the donor sheet. Salicylic acid is preferred since it is capable of volatilizing readily from the donor sheet to the receptor sheet at normal thermal imaging temperatures (about 125°-175° C.) to form the desired image thereon. In general, organic acids having a pKa of from 2 to 5 are employed.

The binder preferably employed for the volatilizable organic acid is nitrocellulose, such as Hercules Nitrocellulose SS. Other suitable polymeric binders include Eastman Chemical Products Alcohol Soluble Propionate, Union Carbide's Bakelite VAGH (a partially hydrolyzed vinyl chloride-vinyl acetate copolymer), Hercules Parlon S (chlorinated isoprene rubber), Dow Ethyl Cellulose, and General Mills Milvex Nylon. The binder is selected so that the acid layer is non-tacky in the non-image areas, and permits ready volatilization of the organic acid at thermal imaging temperatures. A tacky layer can create a problem of transfer to the non-image areas in the receptor sheet, thereby potentially causing undesirable background color formation. The concentration of the binder can range between 10% to 150% of the weight of the acid. A pigment is preferably employed in the acid donor sheet layer formulation to assist in achieving good coating uniformity and to help eliminate transfer of the acid layer to the non-image areas of the receptor sheet during imaging. Acid layer transfer in the non-image areas is also minimized by the selection of binders with softening temperatures that are higher than the melting point of the acid.

A fatty acid or fatty acid salt may be employed in combination with the heat volatilizable organic acid in the donor sheet. The fatty acid or fatty acid salt serves to control the crystallization of the acid, thereby making it more readily volatilizable. A higher rate of volatilization provides greater thermal thrust to the acid so that it can more fully penetrate into the dye precursor layer, thereby ensuring a complete reaction and color formation in the image areas. Fatty acid or fatty acid salt additives which can be employed include saturated and unsaturated fatty acids having from 10 to 26 carbon atoms, such as lauric acid, stearic acid, myristic acid, behenic acid, palmitic acid, capric acid, linoleic acid, oleic acid, etc.. Metallic stearates, such as zinc stearate, aluminum stearate, lithium stearate, barium stearate, potassium stearate, calcium stearate, tin stearate, magnesium stearate and cadmium stearate, may also be employed with advantage. Other useful additives in this regard are metal salts of other fatty acids such as aluminum palmitate, zinc palmitate, zinc oleate and aluminum laurate. Generally, the metallic salts comprise fatty acid salts of metals of Groups IA, IIA, IIIA, IVA, IB, IIB, VIIB and VIII of the Periodic Table. If employed, the optimal range of concentration of fatty acid or fatty acid salt additive is from about 5 to 50% by weight of the volatilizable acid in the formulation. However, the upper limit is not critical for the formation of image and is only limited by practical considerations depending on the choice of the additive such as cost, coating rheology, etc..

For the production of color transparencies, the substrate base of the donor sheet must be essentially transparent to infrared radiation. Many sheet materials have this property, such as polyesters, polystyrene, polycarbonates, polysulfones, glassine, etc.. One-half mil polyester sheet is advantageous since it provides a good balance between rigidity on the one hand, and thermal conductivity, on the other hand. The organic acid to be heat volatilized to the receptor sheet is disposed thereon together with the fatty acid or fatty acid salt additive, if employed, in a suitable binder.

The base substrate in the receptor sheet can be any infrared transmitting and visually transparent material, such as polystyrene, polycarbonates, polyesters, polysulfones, cellulose acetate, however, a polyester base sheet is also advantageous as with the donor sheet. The dye precursor components contained in the receptor sheet can be any of those known and used in the prior art such as disclosed in U.S. Pat. No. 3,502,871. Examples from said patent of such dye-forming chromogenous electron donor components, which are colorless or weakly colored in a non-acid state but are strongly colored when treated with a volatilizable acid, are listed in Table I.

TABLE I

| Dye | | Alkalizing | Image |
|---|---|---|---|
| Commercial name | C.I. No. | agent | color |
| Victoria Green B Base. | Solvent Green 1 | | Green. |
| Rhodamine BI Base. | Solvent Red 49 | " | Magenta. |
| Methyl Green | Basic Blue 20 | KOH | Blue-Green. |
| Auramine Base | Solvent Yellow 34. | None or KOH | Yellow. |
| Methyl Violet Base | Solvent Violet 8 | KOH | Purple. |
| Ethyl Violet | Basic Violet 4 | KOH | Blue-Violet. |
| Sandocyl Red B4G | Basic Red 14 | KOH | Red. |
| Sandocyl Red B3B | Basic Red 15 | KOH | Red. |
| Sandocyl Yellow B6GL. | Basic Yellow 13 | KOH | Yellow. |
| Sandocyl Blue B6G | Basic Blue 1 | KOH | Blue. |
| Magenta ABN Cone. | Basic Violet 2 | KOH | Magenta. |
| Of the listed dyes, the following combinations produce additional colors | | | |
| Auramine Base, Methyl Violet Base | | KOH | Black |
| Auramine Base, Rhodamine BI Base | | KOH | Orange |
| By including in the coating a dye not sensitive to color change by the process, tinted backgrounds are obtained. An example of this is: | | | |
| Auramine Base, Victoria Green B Base., Rhodamine BI Base | | None | Black |
| Azosol Fast Red BE. | Solvent Red 8 | To give light red background color | |

The barrier coating of the invention must have a low permeability to acids at storage and handling temperatures to prevent premature reaction of the acid and the dye precursor. Accordingly, thermoplastic polymeric materials having a permeability coefficient to water of no greater than 150 at about 25° C. are employed as the barrier coating in accordance with this invention (A listing of permeability coefficients is found in "Diffusion in Polymers" edited by J. Crank, G.S. Park; Academic Press 1968). Table II lists exemplary thermoplastic polymeric materials which have been evaluated for their effectiveness as barrier coatings in a thermographic imaging assembly.

TABLE II

| Polymer | Commercial Name | Measurement Temperature (° C) | Permeability Coefficient $P_{10} \times 10^9$ $\frac{cc(s.t.p.)\ cm^{-2}\ sec^{-1}}{cm\ (Hg)\ cm^{-1}}$ |
|---|---|---|---|
| Effective Barriers: | | | |
| Polyvinyl alcohol | Gelvatol 1-90 | 25 | 1.9 - 9.6 |
| Chlorinated polyisobutene/isoprene | Parlon S-20 | 37.5 | 12 |
| Polyvinyl chloride-vinyl acetate copolymer | Bakelite VAGH | 32 | 28 - 32 |
| Polyvinyl chloride-vinyl acetate copolymer | Bakelite VROH | 32 | 28 - 32 |
| Polystyrene | Monsanto crystal 347 | 25 | 97 |
| Ineffective Barriers: | | | |
| Polyvinyl butyral | Butvar B-76 | 25 | 185 |
| Polyethyl methacrylate | Acryloid B-66 | 25 | 350 |

TABLE II-continued

| Polymer | Commercial Name | Measurement Temperature (° C) | Permeability Coefficient $P_{10} \times 10^9$ $\frac{cc(s.t.p.)\ cm^{-2}\ sec^{-1}}{cm\ (Hg)\ cm^{-1}}$ |
|---|---|---|---|
| Polyethyl methacrylate | Acryloid B-67 | 25 | 350 |
| Polyethyl methacrylate | Acryloid NAD-10 | 25 | 350 |
| Polyethyl methacrylate | Acryloid XR-31 | 25 | 350 |
| Cellulose nitrate | Nitrocellulose, SS grade | 20 | 450 |
| Ethyl cellulose | Ethyl cellulose, N-22 | 25 | 2100 - 2380 |
| Cellulose acetate | Eastman's E394 | 25 | 600 - 15,000 |

Barrier coatings which have a permeability coefficient to water of less than 150 are most effective in preventing premature color formation at normal storage and shipping temperatures. Those which have a greater permeability allow excessive diffusion of the acid from the donor sheet to the receptor or dye precursor layer thereby causing premature color formation or fogging.

The barrier layer must be acid resistant, neither dissolving in or reacting with the acid in the donor sheet which would circumvent its function. For example, vinylidene chloride polymers and copolymers are subject to acid hydrolysis which produces hydrogen chloride. This acidic hydrolysis product can diffuse into the receptor layer thereby causing premature color formation.

A suitable barrier coating must additionally have a high permeability to acids at imaging temperatures, so that color formation can be rapid and complete thereby ensuring a dense image. Accordingly, the barrier coats of this invention are thermoplastic which permit the desired diffusion of the acid into the dye precursor layer at the imaging temperatures employed.

Unlike most thermoplastic materials, thermosetting polymers which can effectively protect the precursor layer from premature reaction with the acid in the donor sheet during storage and handling also have poor permeability at imaging temperatures. Thus, thermosetting polymers can provide good shelf life but at the serious expense of image density. However, it is possible to utilize a polymer with minor thermosetting character, i.e., a small degree of crosslinking, without significant reduction of the thermoplastic character of the polymer and hence its diffusion characteristics at the imaging temperatures employed.

In addition to the above parameters, the barrier layer must be relatively thin, i.e., a dry coating weight no greater than about 10 pounds per 1000 square yards of substrate film. The lower weight limit is dependent upon the ability to form a continuous, discrete layer. In practice, a dry coating weight range of 0.25 to 1.50 pounds per 1000 square yards is found to produce good continuous films and effective barrier qualities.

Materials meeting the requirements outlined above and which effectively serve as a barrier layer in accordance with the invention include Parlon S (Hercules chlorinated rubber), Parlon P (Hercules chlorinated polypropylene), Dow Tyril 867 (styreneacrylonitrile copolymer), Chlorowax 70 (Diamond Shamrock trademark for a series of liquid and resinous chlorinated paraffins containing about 70% chlorine by weight), Monsanto Crystal 347 polystyrene (molding grade) and Union Carbide Bakelite VAGH (vinyl chloridevinyl acetate copolymer).

While the donor-receptor sheet assembly of the invention is designed primarily for use with leuco dye color precursors, it is to be understood that the barrier coating of the invention can be employed with any assembly to be used in an infrared imaging process which is based on a pH change. For example, a negative working projectual film may be obtained by the use of a dye layer on a polyester film where the dye is rendered colorless by an acid.

The following examples are given merely as illustrative of the present invention and are not to be considered as limiting. Unless otherwise indicated, the amounts of ingredients therein are by weight.

WORKING EXAMPLES

EXAMPLE 1

A receptor sheet was prepared by coating a 3 mil polyester film with 11.75% of Acryloid A-10 (a resin having a high concentration of polymethylmethacrylate polymers and a low concentration of polyethylacrylate) and 1.4% of dye precursors such as a combination of Auramine, Fuchsine and Malachite Green, dissolved in a solvent system containing by weight 38.6% of methyl ethyl ketone and 48.25% of ethylene glycol monomethyl ether. The coating was applied with a No. 10 wire wound rod which resulted in a dry coating thickness of about 0.0001 inch. A barrier coating of Parlon S-20 is applied from the following solution to the dye layer of the receptor sheet by using a No. 6 wire wound rod and drying at 100° C. to give a dry weight of 0.5 pounds per 1000 square yards:

| | |
|---|---|
| Parlon S-20 | 1.5 |
| Toluene | 51.2 |
| Cyclohexane | 47.3 |
| | 100.0 |

The donor sheet was prepared by applying the following coating on 0.5 mil polyester film using a No. 8 wire wound rod which gave a coating weight of 1.1 lbs./3000 square feet:

| | |
|---|---|
| 10% SS Nitrocellulose in methanol | 61.55 |
| Methanol | 19.02 |
| Toluene | 3.53 |
| Salicyclic acid | 12.75 |
| Lauric acid | 2.09 |
| Silica | 1.06 |
| | 100.00 |

The donor and receptor sheets were placed in face-to-face contact on a printed original so that the donor sheet was in contact with the original. This composite was exposed to infrared radiation in a thermal imaging machine (e.g., 3M Secretary) for a time sufficient to produce a dense black image in the receptor sheet coating.

An accelerated test for comparing relative fogging or pre-exposure was used. The test consisted of placing the donor sheet and the barrier coated receptor sheet in face-to-face contact. This composite was placed between two pieces of plate glass at 82° C. for 4 minutes. The separated receptor sheet was read on a MacBeth TD-518 Densitometer using the visual filter. The Parlon S-20 barrier layer protected the dye layer so that no color formation or fogging took place. The fogging density obtained upon accelerated aging without the barrier layer was 0.56.

EXAMPLE 2

The same procedure was used as in Example 1 except that the following solution containing Dow Tyril 867 (styrene-acrylonitrile copolymer) was used to prepare the barrier layer:

| | |
|---|---|
| Tyril 867 | 1.50 |
| Methyl Ethyl Ketone | 49.25 |
| Toluene | 49.25 |
| | 100.00 |

A small but acceptable amount of coloration or fogging was obtained (0.01–0.05 density units) upon accelerated aging.

EXAMPLE 3

| | |
|---|---|
| Polystyrene, Crystal 347 | 1.50 |
| Methyl Ethyl Ketone | 49.25 |
| Toluene | 49.25 |
| | 100.00 |

A moderate but acceptable amount of coloration or fogging was obtained (0.01–0.17) upon accelerated aging.

EXAMPLE 4

The following solution of Monsanto Butvar B-76 (polyvinyl butyral) was used as in Example 1 for the barrier layer:

| | |
|---|---|
| Butvar B-76 | 1.50 |
| Methyl Ethyl Ketone | 49.25 |
| Toluene | 49.25 |
| | 100.00 |

A fog density of 0.47 was obtained upon accelerated aging, which is excessive and unacceptable.

EXAMPLE 5

The following solution of Hercules ethyl cellulose N-22 was used as in Example 1 for the barrier layer.

| | |
|---|---|
| Ethyl Cellulose, N-22 | 1.50 |
| Methyl Ethyl Ketone | 49.25 |
| Toluene | 49.25 |
| | 100.00 |

A fog density of 0.52 was obtained upon accelerated aging, which is excessive and unacceptable.

EXAMPLE 6

The same procedure was used as in Example 1, except that the dye precursor employed in the receptor sheet was Victoria Green B (Solvent Green 1). A strongly colored green image was produced in the receptor sheet coating after thermal imaging.

When the accelerated aging test described in Example 1 was conducted, essentially no color formation or fogging took place in the receptor sheet containing the barrier coat.

The invention being thus described, it will be obvious that the same may be varied in many ways. Such variations are not to be regarded as a departure from the spirit and scope of the invention and all such modifications are intended to be included within the scope of the following claims.

It is claimed:

1. An infrared radiation transmitting assembly for use in a thermographic process for producing an imaged transparency corresponding to an imaged original sheet, which comprises an acid donor sheet, a receptor sheet which is receptive to the acid in said donor sheet and reactive therewith to form colored images corresponding to the images on the original sheet, and a substantially infrared transparent, acid-resistant thermoplastic polymeric barrier layer disposed between said donor sheet and said receptor sheet, said barrier layer having a permeability coefficient to water of less than 150 at about 25° C. and permitting diffusion of said volatilizable organic acid into the receptor sheet at thermal imaging temperatures, said acid donor sheet comprising an infrared-transmitting substrate sheet material carrying a layer comprising an organic acid which is volatilizable at the temperature of thermographic imaging and a polymeric binder for said organic acid, and said receptor sheet comprising a clear, infrared-transmitting plastic film carrying a coating comprising a substantially colorless acid-sensitive dye precursor which develops an intense color upon reaction with said acid.

2. The assembly of claim 1, wherein said barrier layer is a member selected from the group consisting of chlorinated rubber, chlorinated polypropylene, styrene-acrylonitrile copolymer, chlorinated paraffins, polystyrene and vinyl chloride-vinyl acetate copolymer.

3. The assembly of claim 1, wherein said barrier layer is a continuous, discrete layer having a coating weight of up to about 10 pounds per 1000 square yards.

4. The assembly of claim 1, wherein said donor sheet further includes a fatty acid additive having from 10 to 26 carbon atoms or a metal salt thereof.

5. The assembly of claim 1, wherein the volatilizable organic acid is salicylic acid.

6. The assembly of claim 4, wherein the additive in the donor sheet is lauric acid and said binder is nitrocellulose.

7. The assembly of claim 1, wherein said donor substrate sheet material and said clear plastic film in the receptor sheet are polyester films.

8. An infrared radiation transmitting assembly for use in a thermographic process for producing an imaged transparency corresponding to an imaged original sheet, which comprises an acid donor sheet, a receptor sheet which is receptive to the acid in said donor sheet and reactive therewith to form images corresponding to the images on the original sheet, and a substantially infrared transparent, acid-resistant thermoplastic polymeric barrier layer disposed between said donor sheet and said receptor sheet, said barrier layer having a permeability coefficient to water of less than 150 at about 25° C., and permitting diffusion of said volatilizable organic acid into the receptor sheet at thermal imaging temperatures, said acid donor sheet comprising an infrared-transmitting substrate sheet material carrying a layer comprising an organic acid which is volatilizable at the temperature of thermographic imaging and a polymeric binder for said organic acid, and said receptor sheet comprising a clear, infrared-transmitting plastic film carrying a coating comprising an acid-sensitive dye which is rendered colorless upon reaction with said acid.

9. A receptor sheet for use in thermographic imaging which comprises a substrate sheet material which is transparent to infrared radiation, a first layer comprising a substantially colorless acid-sensitive dye precursor which develops an intense color upon reaction with a heat-volatilizable organic acid and a barrier layer thereover comprising a substantially infrared transparent, acid-resistant polymer having a permeability coefficient to water of less than 150 at about 25° C. and having thermoplasticity so as to permit diffusion of said volatilizable organic acid into the dye precursor layer of the receptor sheet at thermal imaging temperatures.

10. A receptor sheet in accordance with claim 9, wherein said barrier layer is a member selected from the group consisting of chlorinated rubber, chlorinated polypropylene, styrene-acrylonitrile copolymer, chlorinated paraffins, polystyrene and vinyl chloride-acetate copolymer.

11. A receptor sheet in accordance with claim 9, wherein said barrier layer is a discrete continuous layer with a coating weight of up to about 10 pounds per 1000 square yards.

12. A receptor sheet for use in thermographic imaging which comprises a clear infrared-transmitting plastic film, a first layer comprising an acid-sensitive dye which is rendered colorless upon reaction with a heat-volatilizable organic acid, and a barrier layer thereover comprising a substantially infrared transparent, acid-resistant polymer having a permeability coefficient to water of less than 150 at about 25° C. and having thermoplasticity so as to permit diffusion of said volatilizable organic acid into the dye layer of the receptor sheet at thermal imaging temperatures.

13. An acid donor sheet for use in thermographic imaging which comprises a substrate sheet material which is transparent to infrared radiation, a first layer comprising a heat volatilizable organic acid and a polymeric binder therefor, and a barrier layer thereover comprising a substantially infrared transparent, acid-resistant polymer having a permeability coefficient to water of less than 150 at about 25° C. and having thermoplasticity so as to permit diffusion of said volatilizable acid into the dye precursor layer of a receptor sheet at thermal imaging temperatures.

14. An acid donor sheet in accordance with claim 13, wherein said barrier layer is a member selected from the group consisting of chlorinated rubber, chlorinated polypropylene, styrene-acrylonitrile copolymer, chlorinated paraffins, polystyrene and vinyl chloride-acetate copolymer.

15. An acid donor sheet in accordance with claim 13, wherein said barrier layer is a discrete continuous layer with a coating weight of up to about 10 pounds per 1000 square yards.

16. An acid donor sheet in accordance with claim 13, wherein said first layer further includes a fatty acid additive having from 10 to 26 carbon atoms or a metal salt thereof.

* * * * *